United States Patent [19]

Kawaguchi et al.

[11] Patent Number: 4,540,065

[45] Date of Patent: Sep. 10, 1985

[54] APPARATUS FOR WALL TIMBERING OF DRIFTS, TUNNELS, AND THE LIKE

[75] Inventors: Seiji Kawaguchi; Takeki Fujiwara; Shigeo Kodama; Haruo Ito; Kyuemon Yamamoto, all of Oodate, Japan

[73] Assignee: Dowa Mining Co., Ltd., Tokyo, Japan

[21] Appl. No.: 566,187

[22] Filed: Dec. 28, 1983

[30] Foreign Application Priority Data

Dec. 30, 1982 [JP] Japan ..... 57-233226

[51] Int. Cl.[3] ..... E21D 15/58

[52] U.S. Cl. ..... 182/63; 182/2; 405/303

[58] Field of Search ..... 182/63, 2, 62.5, 129; 405/303

[56] References Cited

U.S. PATENT DOCUMENTS 3,091,305 5/1963 Pickard ..... 182/63
3,356,181 12/1967 Granger ..... 182/63
4,260,297 4/1981 Houston ..... 182/2
4,356,887 11/1982 Fisher ..... 182/63

*Primary Examiner*—Reinaldo P. Machado
*Assistant Examiner*—Alvin Chin-Shue
*Attorney, Agent, or Firm*—Toren, McGeady, Stanger, Goldberg & Kiel

[57] ABSTRACT

Apparatus mounted on a self-propelled truck, and provided with mechanisms for effectively, smoothly, and safely performing various timbering work in drift and tunnel walls and roofs. The mechanism includes a working platform which is rotatable and kept horizontal for easy conveyance of timbering materials even in a narrow drift and for steady performance of timbering by workers on the platform. Planting of props is readily performed by a device provided to the platform, which grasps a prop, shifts it and erects the prop over a selected pit, and bridging of top beams over capitals of planted props is accurately made by lifting means provided on the working platform.

5 Claims, 13 Drawing Figures

APPARATUS FOR WALL TIMBERING OF DRIFTS, TUNNELS, AND THE LIKE

BACKGROUND OF THE INVENTION

This invention relates to an apparatus for timbering, which can perform various functions in connection with the reinforcement of walls of tunnels and underground mining levels and shafts as tunneling or drift work proceeds.

Lately, in the tunneling and drift work, its rock drilling operation and conveyance operation of crushed rocks have been considerably mechanized, and machines employed for the operations are getting larger and more automatized.

However, timbering operation which is to reinforce driven pit walls with frames, remains as it was, and is still performed by human power. For example, even the planting of props is made by human power. And, for laying top beams over capitals of props, a scaffold is built, upon which several underground workers stand for pulling up the beams and lifting them to a roof. This manner or kind of operations bring about often the falling of timbering materials and workers from the scaffold, as the operations are done at an elevated and unstable position. Such falling invites sometimes a secondary accident which makes the timbering operation dangerous. In order to prevent such accident, additional workers have to be stationed. This inevitably makes the drift work more expensive. And, in addition to the danger and increase of timbering cost, it requires time and labor to build and dismantle the scaffold and to transport materials required for the scaffold.

As briefed above, conventional wall and roof timbering operations of drifts and tunnels are accompanied with a number of drawbacks which are related with safety and efficiency of drift and timbering work. Though mechanization of such work has been sought, it has been difficult because sites where the operations are performed are narrow and small.

BRIEF SUMMARY OF THE INVENTION

In view of the above, this invention is to provide an apparatus for timbering of tunnels and pits, which is afforded with such various functions which improve safety and work efficiency of the wall and roof timbering of drifts and the like.

Functions the apparatus of this invention can achieve are as follows.

(a) A scaffold of a selected height can be promptly provided as demanded.

(b) The working platform of the scaffold can readily and rightly be held in a horizontal position, irrespectively of the level or slope of a seam of drift.

(c) Means for plumbing and planting props and means for lifting top beams and bridging them across the capitals of beams are provided to the apparatus.

(d) Conveyance means for timbering materials and tools are provided to the apparatus so that their independent conveyance is eliminated and conveyance time is minimized.

(e) The apparatus, especially its rotatable working platform allows a truck loaded with long props and beams to turn sharp and narrow corners of drifts.

(f) The width of the working platform can be adjusted in accordance with that of a drift.

More specifically, the apparatus made in accordance with this invention comprises a working platform mounted on self-propelled vehicles such as a truck, which platform is adjustable of its height to a desired level, and is provided with mechanisms which enable the platform to be in a horizontal position irrespective of conditions in a drift bed, mechanisms which enable the platform to be rotated so that timbering work can be done in any direction, mechanisms which enable the platform to carry and rotate a prop to a desired angular distance and to plant it plumb at a desired position, mechanisms consisting of an auxiliary stage, by which the working platform can be expanded so that its width meets with that of a drift, and mechanisms which can lift a top beam to a desired height and have it bridged across capitals of props.

DETAILED DESCRIPTION OF EMBODIMENT

Figure 1:
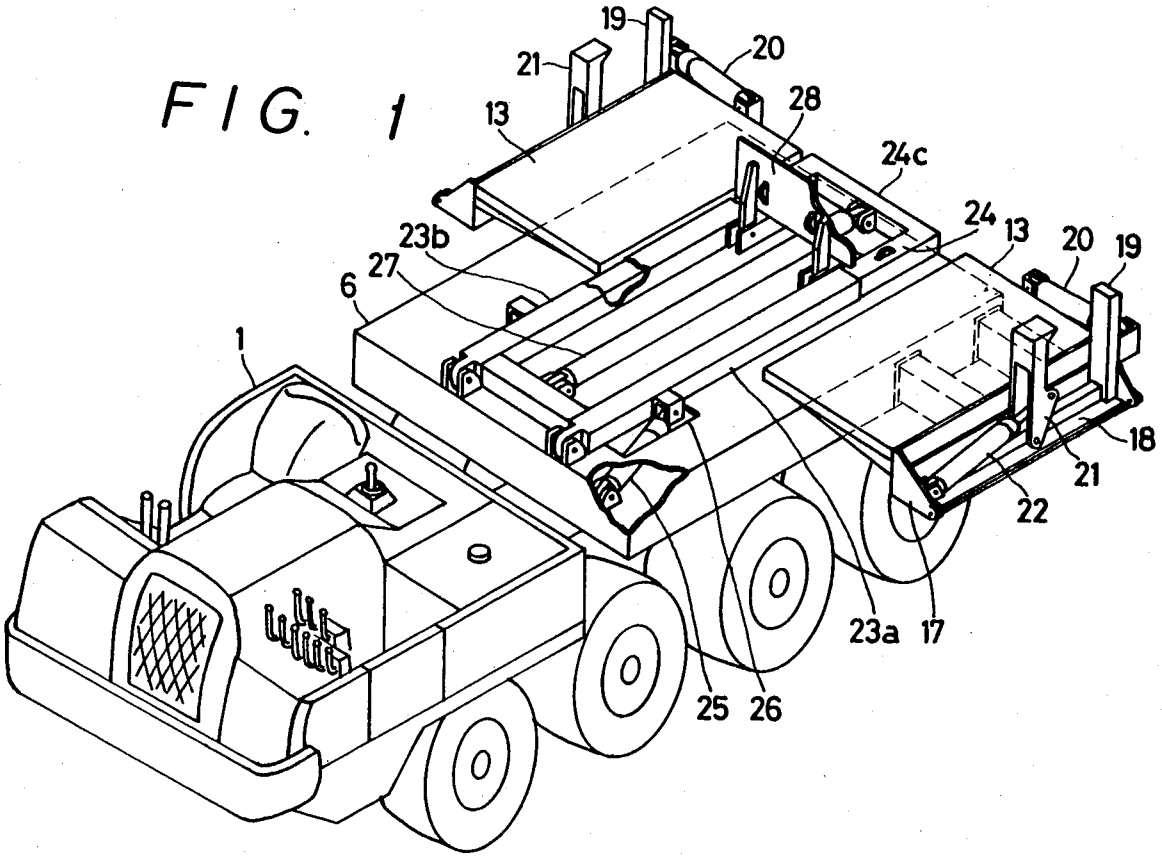
FIG. 1 is a perspective view of a timbering apparatus made in accordance with this invention, which is mounted on a truck.
Figure 2:
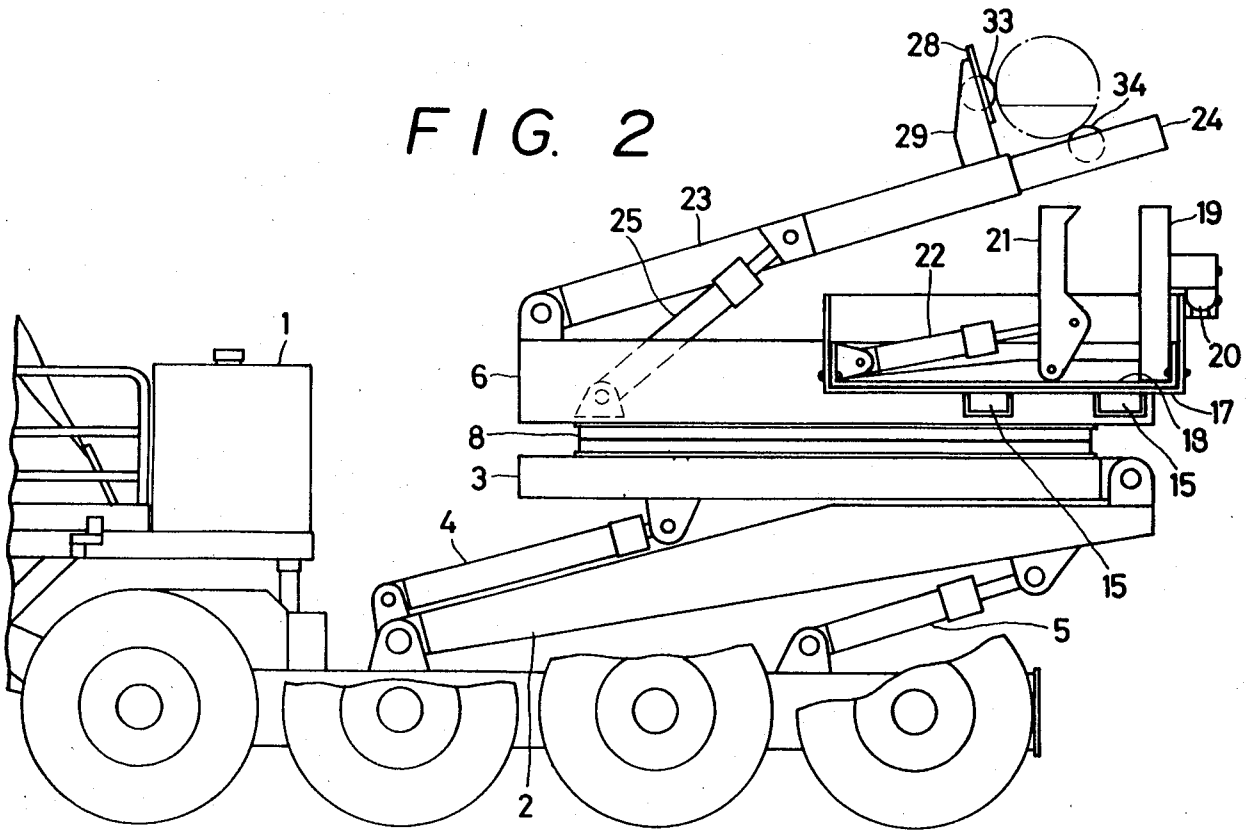
FIG. 2 is a side elevational view of the apparatus.
Figure 3:
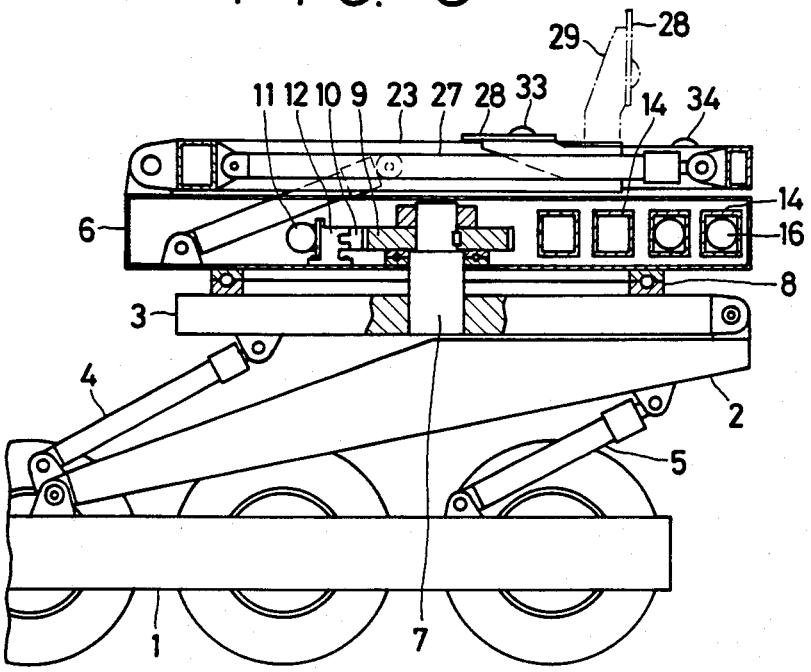
FIG. 3 is a side view showing rotary mechanisms of a working platform provided to the apparatus.

An embodiment of the apparatus made in accordance with this invention is explained hereunder with reference to the accompanying drawing.

Numeral 1 indicates generally a self-driven truck, above which there is mounted a horizontally retainable table 3 by means of a pair of elongated swing stays 2, base ends of which are pivoted at front sides of the truck and top ends of which are pivoted at rear sides of the table 3. A pair of cylinders 4 are fitted at their free ends to the forward bottom parts of the table 3, while their base ends are pivoted to the front sides of the truck 1. Another pair of cylinders 5 are each pivotally fitted at their free ends to the rear bottom parts of the stays 2, while their base ends are pivotally fitted on the rear parts of the truck 1. By these arrangements, the stays 2 make a vertical swinging motion above the truck 1 and about their lower pivots when the cylinders 5 are operated. Likewise, the cylinders 4 make a swinging motion when they are operated. Thus, the table 3 is raised to a desired height by the cylinders 5, and kept to a horizontal position by the cylinders 4.

Figure 4:
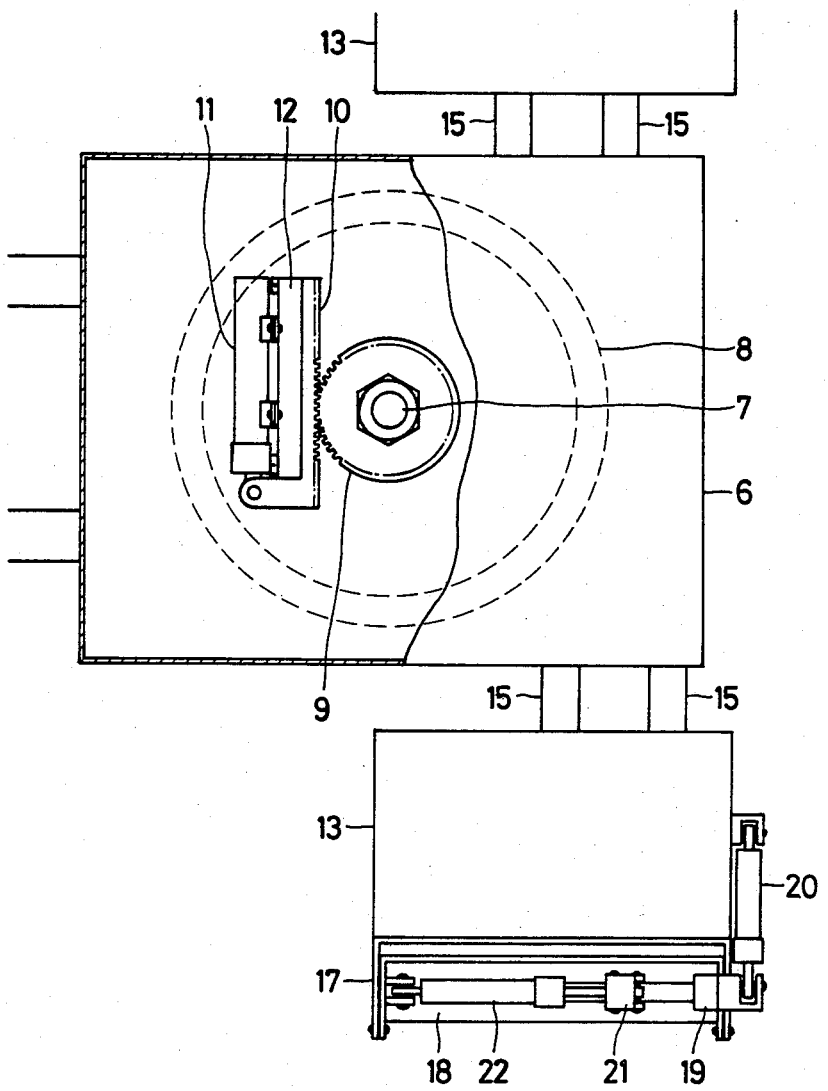
FIG. 4 is a plan view of the rotary mechanisms.

Numeral 6 indicates a box-like working platform which is mounted on the horizontally retainable table 3. The platform 6 is pivotally mounted at its center on a center pin 7 which is fitted to the center of the table and projects upward therefrom. A plurality of bearings 8 which are located radially outwardly from the center pin 7 with angular distances therebetween, assist the working platform 7 to rotate smoothly on the table 3. To an upper part of the center pin 7 which projects from the table and is housed within the platform box 6, there is fixed a pinion gear 9. This pinion gear is in mesh with a rack gear 10 which is also housed within the platform box 6. As best shown in FIG. 4, the rack 10 moves slidingly along a rack guide 12 by a cylinder 11, piston rod of which is fitted at its forward end to the rack. Thus, when the cylinder 11 is operated, the pinion gear 9 meshed with the rack 10 rotates, whereby the platform 6 is rotated about the center pin 7 of the table 3.

Figure 5:
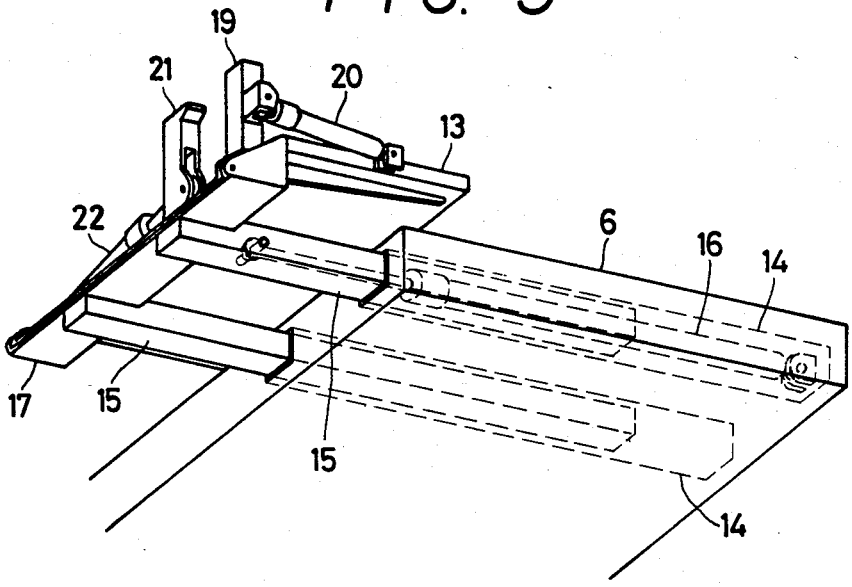
FIG. 5 is a perspective view of an auxiliary stage provided to the working platform.

Numeral 13 indicates auxiliary stages which are provided at both lateral sides of the working platform 6, which stages work to adjust a working space of the platform 6 in accordance with the width of a drift. Each of the auxiliary stages 13 has, as best shown in FIG. 5, bifurcated slides 15 which are inserted to slide cases 14. The slides 15, one of which is connected at its free end with a cylinder piston 16 mounted in the slide case, protrude from or retreat into the cases 14, whereby one of or both of the auxiliary stages 13 extend outwardly from the working platform for expanding a working space.

Figure 6:
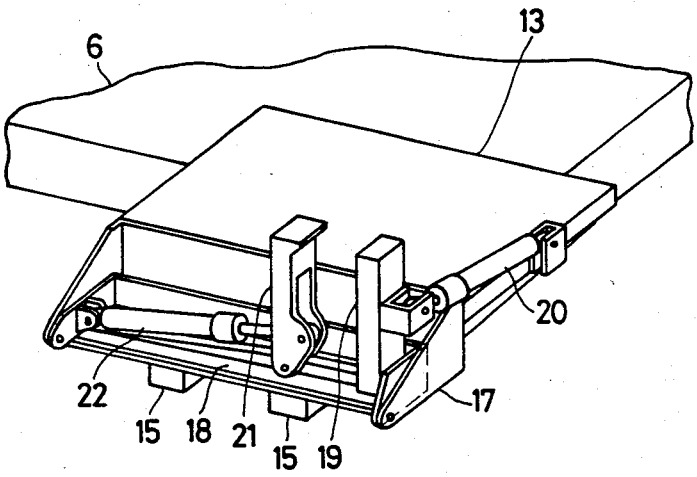
FIG. 6 is a perspective view of the catcher mechanisms of the working platform, FIG. 6-A is a view showing the operation of the catcher mechanisms.
Figure 6:
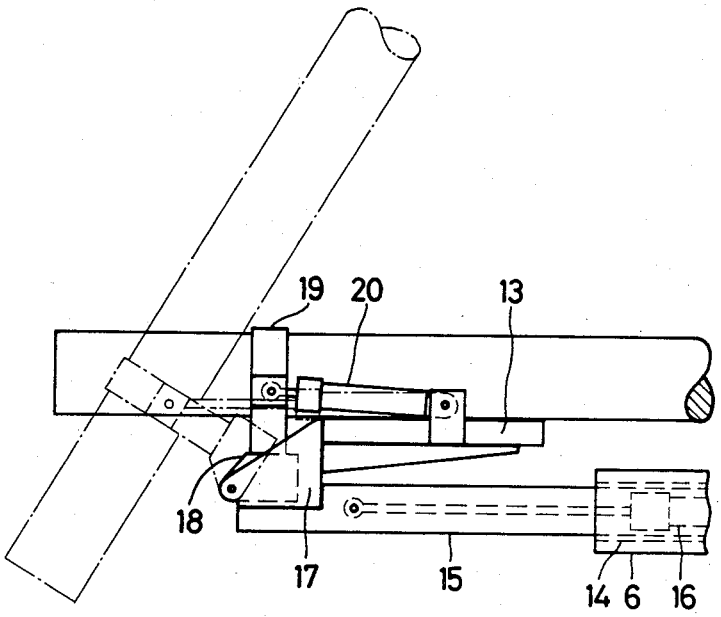
Figure 8A:
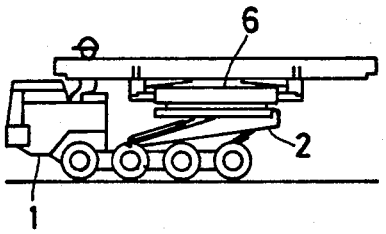
Figure 8B:
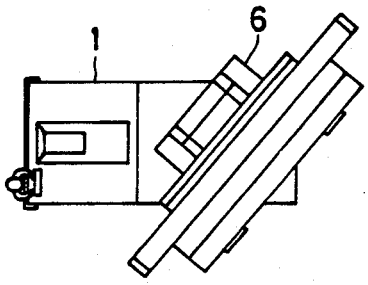
Figure 8C:
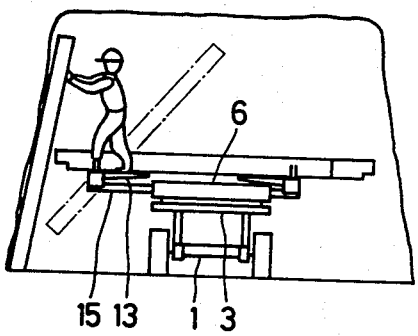
Figure 8D:
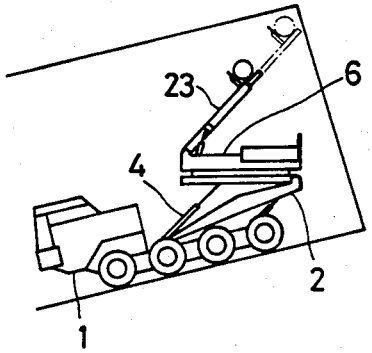
Figure 8D:
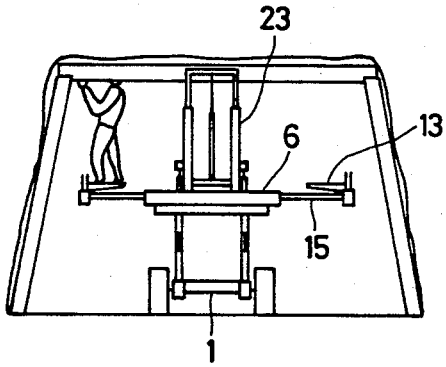

As shown in FIG. 6, there are provided at both of lateral sides of the auxiliary stages 13 such mechanisms which can grasp a prop, and rotate and erect it. Said mechanisms comprise a pair of plates 17 which extend outwardly from both sides of the stage 13, a link plate 18, ends of which are pivotally fitted to the forward ends of the side plates 17 so as to rotate about its pivoted points by a piston cylinder 20. A catcher plate 19 is provided to the link plate 18 so as to project at a side of said plate at a right angle therewith. The aforementioned piston cylinder 20, base end of which is pivoted to the auxiliary stage 13 connected at its free end to an upper part of the catcher plate 19. By the protrusion of the piston rod of cylinder 20, the link plate 18 rotates counter-clockwise in the drawing, FIG. 6. Numeral 21 indicates a catcher which stands upright on the link plate 18 and confronts against the catcher plate 19. The height of the catcher plate 19 and the catcher 21 is is more than the horizontal upper level of the auxiliary stage 13 so that a prop which is laid upon the said stage can be grasped at one of its ends by the catcher plate and the catcher. The catcher 21 is pivotally fitted at its middle part with the free end of the cylinder piston 22, while the said piston is pivotally fitted at its base end to one of the lateral side of the rotatable link plate 18 so as to move swingingly the catcher 21 toward and apart from the catcher plate 19, upon the operation of piston 22. By these arrangements, a prop laid down upon the auxiliary stage 13 is grasped at its end between the catcher plate 19 and the catcher 21, erected as it is grasped by the operation of piston 20, and moved laterally outwardly from the working platform by the lateral extension of the auxiliary stage 13 so as to slant the prop at a desired position.

Numeral 23 indicates a U-shaped lift frame consisting of lateral square columms 23*a*, 23*b* which are connected at their ends with a base bar. Said ends are pivoted to the forward part of the working platform 6, while their free ends insertedly receive sliding arms 24*a*, 24*b* of a reversed U-shaped sliding frame 24. The sliding arms 24*a*, 24*b* are connected by a base bar 24*c*. To middle portions of the column 23*a*, 23*b*, there are pivotally fitted free ends of cylinder pistons 25, base ends of which are in turn pivotally fitted to the front base of the working platform 6. Elongated slots 26 which are provided at the upper surface of the platform box 6, permit the cylinder pistons 25 to protrude from said box 6. The operation of the cylinder pistons 25 makes the U-shaped lift frame swing to a desired angular position together with the reversed U-shaped frame arm 24, so that they are elevated over the working platform with an angular distance therebetween. Another cylinder 27, the base of which is pivotally fitted to the base bar of the U-shaped lift frame and freely protruding end of which is pivotally fitted to the bar 24*c* of the reversed U-shaped sliding frame 24, can extend, upon its operation, the sliding arms 24*a*, 24*b* simultaneously and outwardly from the U-shaped lift frame so that the sliding frame 24 is extended as a whole.

Figure 7:
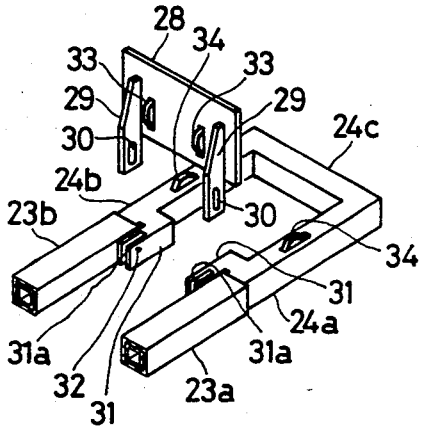
FIG. 7 is a perspective view showing a support plate of a sliding frame insertedly fitted to a lift frame, and FIGS. 8(*a*) to 8(*e*) are explanatory views illustrating various work which is performed with the employment of the present invention apparatus.

Adjacent to the forward end of the sliding frame 24, there is pivotally fitted a support plate 28 which sustains a top beam on said sliding frame. A two legged fork 29 is fitted to the support plate 28 so that it stands at a right angle with the sliding frame. Parts of the fork 29 which project downwardly from the support plate have slots 30. Said parts of the fork are movably fitted to bifurcated spaces 31*a* of the projections 31 which are provided to forward inner portions of the sliding arms 24*a*, 24*b*. Pins 32 which extends through the bifurcated space 31*a* and through the slot 30 of the fork 29 allows the support plate 28 to rotate about the pins 32 counter-clockwise in FIG. 7 and to be laid down horizontally with the lift frame 23. When the support plate 28 is rotated to 90 degree clockwise from its rest position, it can be kept at an upright position by sliding it down so that the topmost ends of the slots 30 engage with the pins 32 to establish a bayonet connection. A pair of rollers 33 which are rotatably located in parallel with the fork 29, and shafts of which extend transversely to the fork in slots provided to the support plate 28, allow a top beam to be manually rotated on the sliding frame 24. Another pair of rollers 34 which are provided on the forward upper portions of the sliding arms 24*a*, 24*b* also assist workers to rotate the top beam on the sliding frame 24.

The aforementioned mechanisms are operated hydraulically or pneumatically by engines mounted on the truck 1, or they may be operated of their transmission mechanisms electrically by motive power on the truck.

How to operate the present invention apparatus in the wall and timbering is explained further below with reference to FIGS. 8(*a*) to (*e*).

Materials for timbering such as props and top beams and tools required for the timbering are mounted on the working platform 6 of truck 1 which can be driven through a drift as desired. While the working platform shown in FIG. 8(*a*) is kept as rotated by 90° from the position shown in FIG. 1, it can be at the position as shown in FIG. 1 or any other rotated position.

When the truck reaches a working face of a drift, timbering work is done by operating levers equipped adjacently to a driver's seat in the truck, as follows for example.

First, the working platform is rotated to a desired angle, as shown in FIG. 8(*b*), by rotating the pinion 9 by the operation of the rack 10 and the cylinder 11 all of which are accommodated within the working platform box. And, in accordance with slope of the drift and height at which workers wish to make timbering, the table 3 is elevated or lowered and adjusted at its horizontal level by cylinders 4 and 5. In case that a drift is an ascent as shown in FIG. 8(*d*), the cylinder 4 is operated first, and then the cylinder 5 is operated so as to make a minute adjustment of the level of platform 6. In case of the drift being a descent, the aforementioned operation is made vice versa.

Then, the operation for planting a prop onto an excavated pit starts. First, by operating the cylinder 22, a prop is grasped at its part as it is laid down, between the catcher 21 and the catcher plate 19. The auxiliary stage 13 is extended by the cylinder 16, whereby the prop is shifted outwardly. As shown in FIGS. 6-A and 8(*c*), the operation of cylinder 20 brings about the outward swinging rotation of the link plate 18, thereby the prop is erected as it is grasped by the catcher and catcher plate, over a pit with a worker's manual assistance if needed. In order to bring the prop rightly over the pit, the working platform 6 can also be rotated.

Thus planted prop may be fixed at its position by fastening it to the adjacently located prop or pile, or may be kept at its erected position being grasped by the catcher and catcher plate, while the planting of a prop at another side of drift is done.

Next, the operation for bridging a top beam over the props planted at both sides of the drift is made. The supporting plate 28 of the slide frame 23 is brought to its upright position. A top beam if mounted on the sliding frame 23 and sustained laterally by the supporting plate 28. The lifting frame 23 is angularly elevated by the operation of cylinder 25. The sliding frame is then expanded by the cylinder 27 until the top beam reaches the capitals of a pair of planted props, as shown in FIGS. 8(*d*) and (*e*). In order to assure that the top beam reach exactly over the capitals of props, it is preferabe to operate the lifting frame 23 and sliding frame 24 simultaneously while minutely adjusting their operation. Recesses provided to the ends of top beam can readily be fitted with the corresponding recesses provided to the capitals of props, by manually rotating and pushing the beam toward the props over the rollers 33 and 34.

After the completion of the above described work, the props and beam are wedged to each other, and fitted with piles. If props are kept at upright positions being grasped by the catcher and catcher plate when they are to be wedged, it is advisable to loosen or retract a little the cylinders for the auxiliary stage 13 and the catcher mechanisms, so that wedging of a prop to another prop and beam can smoothly be made. The catcher 21, link plate 18, lifting frame 23, table 3 and others are returned to their original positions. The truck moves to a next working site.

In addition to the advantages described in the above, it shall be noted that when the truck has to turn at a right angled sharp corner of a narrow drift with long props or beams mounted thereon, the props and beams can be rotated as shown in FIG. 8(*b*) so that they do not hinder the turn of truck.

We claim:

1. An apparatus for wall and roof timbering of drifts and tunnels which comprises:

a self-moved truck having a forward part and a rearward part, a table mounted on the self-moved truck, the table is liftable to a desired height and is horizontally retainable, said table having a forward part a rear end and a top part;

a working platform having lateral sides with the working platform being rotatable mounted on the table and a forward bottom part;

auxiliary stages provided at the lateral sides of the working platform, and the auxiliary stages are extensible laterally outwardly from the working platform;

rotatable catcher means provided on the auxiliary stages for grasping a prop and swingingly erecting the prop; and lift means provided to the working platform, which means is vertically swingable over the platform, the table comprises stays, each having a base and a free end with the base being pivotally fitted to the forward part of the truck and the free end being pivotally fitted to the rear end of the table, and means for elevating said table consisting of first piston cylinders each having base and a free end with each said base being pivotally fitted to the forward part of the truck and each said free end being pivotally fitted to a forward part of the table, and second piston cylinders each having a free end and a base with each said base being pivotally fitted to a forward part of the truck and each said free end being pivotally fitted to the free end of the stays;

the working platform consists of a box-like housing rotatable about an axis centrally provided on the table and upon a plurality of bearings located between the platform and the table and positioned radially outwardly from said axis with angular distances between the bearings;

guide cases provided within the housing of the working platform, and the auxiliary stages have arms slidably inserted in the guide cases, third piston cylinders accommodated within the housing of the working platform, said arms connected to said third piston cylinders and said third piston cylinders being operative to project the arms with the working stages laterally outwardly from the working platform;

the rotatable catcher means consists of a pair of plates which project with a distance therebetween from a lateral side of each of the auxiliary stages at a right angle therewith, a link plate rotatably pivoted to the said pair of plates, a catcher plate provided at one end of the link plate, a fourth piston cylinder having a free end pivotally fitted to the catcher plate and a base pivotally fitted to the auxiliary stage so as to selectively locate the link plate in a horizontal position or an inclined position, the catcher plate projecting over the level of the auxiliary stage in said horizontal position of the link plate, a catcher having a base pivotally fitted to the link plate a top projecting over the level of the auxiliary stage at the horizontal position of the link plate, and a middle part pivotally connected to a free end of a fifth piston cylinder, the fifth piston cylinder having a base pivoted to another end of the link plate, said catcher being operative, upon the actuation of the fifth piston cylinder to grasp a prop between said catcher and the catcher plate; and the lift means consists of a U-shaped lifting frame with a forward end and a middle part and having a base pivotally connected to the working platform, a reversed U-shaped sliding frame having a forward end and slidably connected with the lifting frame, a support plate rockably fitted to the sliding frame adjacent to the forward end of the sliding frame, a sixth piston cylinder having a base pivotally fitted to the forward bottom part of the working platform and a free end pivotally fitted to the middle part of the lifting frame, the sixth piston cylinder being operative to swing the lifting frame vertically, and a seventh piston cylinder having a base pivotally fitted to the base of the lifting frame and a free end pivotally fitted to the base of the sliding frame, said seventh cylinder being operative to extend the sliding frame from the lifting frame.

2. An apparatus as claimed in claim 1, in which the working platform is made rotatable by a pinion gear fixed to the central axis on the top part of the table with the axis projecting into the housing of the working platform, a rack gear meshed with said pinion gear, and an eighth piston cylinder connected to the rack gear to operate said rack gear along a rack guide.

3. An apparatus as claimed in claim 1 or 2, in which the support plate having lateral sides is provided with a two legged fork, each leg of which is located at and along one lateral side of the support plate and having a slot at its part which projects over a rear edge of the support plate, said sliding frame having lateral inner sides with slot openings therein said projected part of each leg being insertedly fitted into one of the slot openings provided in the lateral inner sides of the sliding frame adjacently to the forward end thereof and rockable about the pin fitted into each slot opening through the slot of the leg.

4. An apparatus as claimed in claim 3, in which the support plate of the sliding frame has rollers, and the sliding frame has also rollers at its upper surface between its base and the support plate.

5. An apparatus as claimed in claim 3, in which the support plate is retainable at its upright working position by a bayonet connection effected by the slots of the two legged fork and the pins.

* * * * *